US006016620A

United States Patent [19]

Morgan

[11] Patent Number: 6,016,620

[45] Date of Patent: Jan. 25, 2000

[54] ARM AND HAND GUN SUPPORT APPARATUS

[76] Inventor: Delmas Dale Morgan, 204 W. Pottawatamie St., Tecumseh, Mich. 49286

[21] Appl. No.: 09/007,809

[22] Filed: Jan. 15, 1998

[51] Int. Cl.[7] ..... F41A 27/30

[52] U.S. Cl. ..... 42/94

[58] Field of Search ..... 42/94

[56] References Cited

U.S. PATENT DOCUMENTS

| | | | |
|---|---|---|---|
| 805,189 | 11/1905 | Dubert | 42/94 |
| 1,314,951 | 9/1919 | Drews | 42/94 |
| 1,906,870 | 5/1933 | Palla | 42/94 |
| 3,390,477 | 7/1968 | Galbraith | 42/94 |
| 3,609,902 | 10/1971 | Casull | 42/94 |
| 4,893,427 | 1/1990 | Davidson | 42/94 |
| 5,018,294 | 5/1991 | McGruffee | 42/94 |
| 5,180,874 | 1/1993 | Troncoso | 42/94 |
| 5,723,808 | 3/1998 | Devall | 42/94 |
| 5,778,589 | 7/1998 | Teague | 42/94 |

*Primary Examiner*—Charles T. Jordan
*Assistant Examiner*—Denise J. Buckley

[57] ABSTRACT

An arm and hand gun support apparatus including a first elongated support member has a proximal section with an adjustment rod and a distal section with a cylindrical coupler. The adjustment rod is positioned within the cylindrical coupler for interlocking the distal section and the proximal section. A barrel support has a U-shaped barrel rest and a first support rod, the first support rod having a lower pass through coupled with a second support rod, the second support rod having a has a rotatable locking mechanism with back end with a third support rod projecting therefrom and adjacent the back end. An elbow support member has a first end coupled with the second distal end of the distal section of the first elongated support member. Included is a fourth support rod that has a first end that is coupled with the third support rod of the rotatable locking mechanism of the second support rod, and has a rotatable locking mechanism coupling with a second of the elbow support. A pair of arm supports for securing the arm of a gun user to the first elongated support member.

2 Claims, 4 Drawing Sheets

FIG. 3
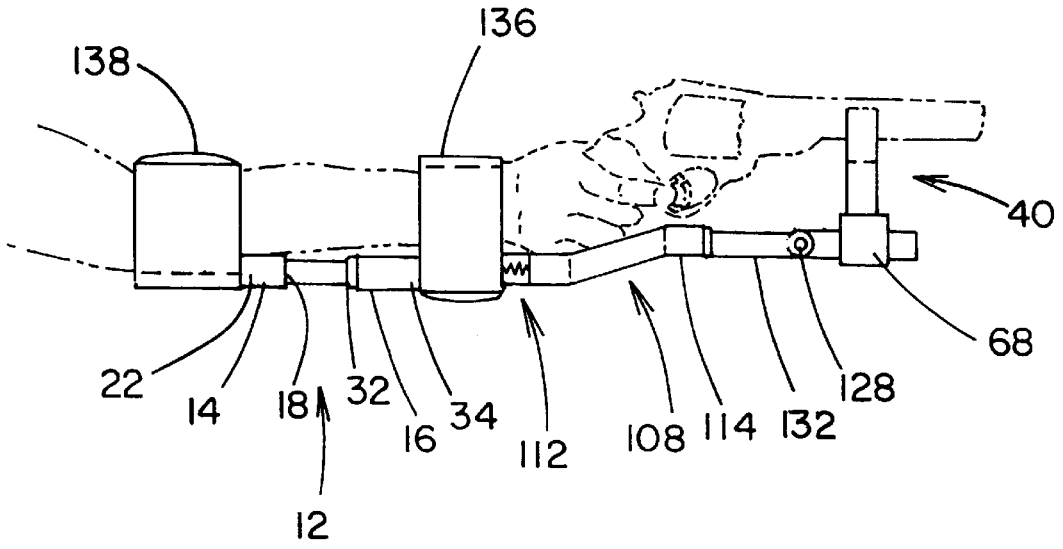
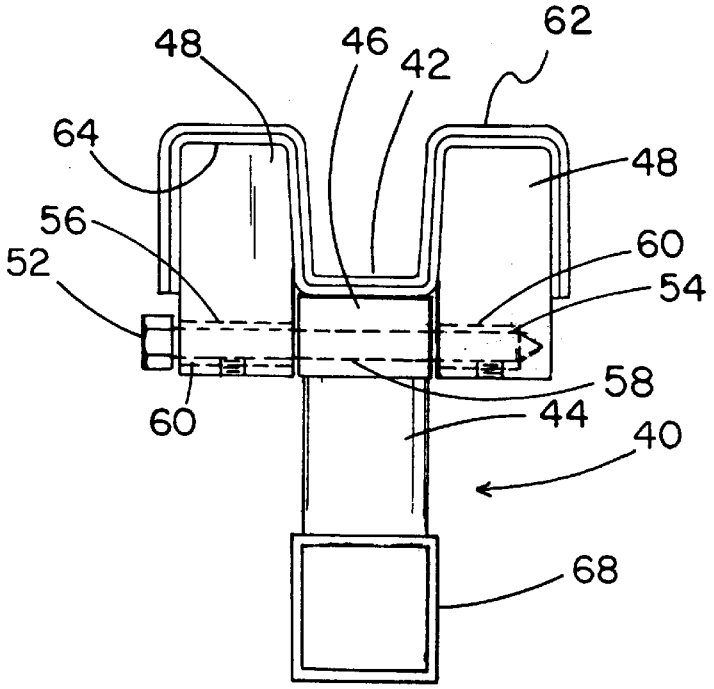
FIG. 4

ARM AND HAND GUN SUPPORT APPARATUS

BACKGROUND OF THE INVENTION

1. Field of the Invention

The present invention relates to an arm and hand gun support apparatus and more particularly pertains to providing a support that is mounted onto the arm to steady the aim of a hand gun user.

2. Description of the Prior Art

The use of a hand gun brace or support is known in the prior art. More specifically, hand gun braces or supports heretofore devised and utilized for the purpose of assisting with the aim of a hand gun user are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,228,610 to Spence discloses a wrist support for hand-held devices. U.S. Pat. No. 4,291,482 to Bresan discloses a stabilizing attachment for a hand gun. U.S. Pat. No. 4,843,749 to Griffith discloses a pistol brace. U.S. Pat. No. 5,018,294 to McGuffee discloses a steady hand. U.S. Pat. No. 5,417,002 to Guerra discloses an adjustable firearm handle. Lastly, U.S. Pat. Des. No. 270,556 to Kneisley discloses a sports wrist brace.

In this respect, the arm and hand gun support apparatus according to the present invention substantially departs from the conventional concepts and designs of the prior art, and in so doing provides an apparatus primarily developed for the purpose of providing a support that is mounted onto the arm to steady the aim of a hand gun user.

Therefore, it can be appreciated that there exists a continuing need for a new and improved arm and hand gun support apparatus which can be used for providing a support that is mounted onto the arm to steady the aim of a hand gun user. In this regard, the present invention substantially fulfills this need.

SUMMARY OF THE INVENTION

In view of the foregoing disadvantages inherent in the known types of hand gun braces and supports now present in the prior art, the present invention provides an improved arm and hand gun support apparatus. As such, the general purpose of the present invention, which will be described subsequently in greater detail, is to provide a new and improved arm and hand gun support apparatus which has all the advantages of the prior art and none of the disadvantages.

To attain this, the present invention essentially comprises a first elongated support member. The first elongated support member has a proximal section and a distal section. The proximal section having a first proximal end and a second proximal end with an adjustment rod projecting outwardly therefrom. The distal section has a first distal end with a cylindrical coupler and a second distal end. The adjustment rod is positioned within the cylindrical coupler for interlocking the distal section and the proximal section.

Included is an adjustable barrel support that has a U-shaped barrel rest and a first support rod. The barrel rest is formed by a small bracket piece and two large bracket pieces coupled together and mounted on the first support rod. The U-shaped barrel rest has a protective material positioned over the small bracket piece and a pair of upper edges of the two large bracket pieces. The first support rod having a lower pass through coupled with a second support rod. The second support rod has a rotatable locking mechanism. The rotatable locking mechanism has a first member and a second member. The second member has back end and a third support rod projecting therefrom and adjacent the back end. The first member has a first serrated side and the second member has a second serrated side. The first member and the second member are resiliently coupled for allowing the first serrated side of the first member to be held in an interlocking orientation with the second serrated side of the second member.

An elbow support member is provided. The elbow support member is formed of a pliable material for contorting. The elbow support member has a first end and a second end. The first end is coupled with the second distal end of the distal section.

Provided is a fourth support rod that has a first end and a rotatable locking mechanism at a second end. The first end is coupled with the third support rod of the rotatable locking mechanism of the second support rod. The rotatable locking mechanism of the fourth support rod has a fifth support rod coupled with the second end of the elbow support member. Lastly, a pair of arm supports are formed by a wrist support for placement over the wrist, and a forearm support for placement under the forearm. Each of the pair of arm supports are secured by a plurality of straps.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved arm and hand gun support apparatus which has all the advantages of the prior art hand gun braces and supports and none of the disadvantages.

It is another object of the present invention to provide a new and improved arm and hand gun support apparatus which may be easily and efficiently manufactured and marketed.

It is a further object of the present invention to provide a new and improved arm and hand gun support apparatus which is of a durable and reliable construction.

An even further object of the present invention is to provide a new and improved arm and hand gun support apparatus which is susceptible of a low cost of manufacture with regard to both materials and labor, and which accordingly is then susceptible of low prices of sale to the consuming public, thereby making such arm and hand gun support apparatus economically available to the buying public.

Still yet another object of the present invention is to provide a new and improved arm and hand gun support apparatus which provides in the apparatuses and methods of the prior art some of the advantages thereof, while simultaneously overcoming some of the disadvantages normally associated therewith.

Still another object of the present invention is to provide a support that is mounted onto the arm to steady the aim of a hand gun user.

Lastly, it is an object of the present invention to provide a new and improved arm and hand gun support apparatus including a first elongated support member has a proximal section with an adjustment rod and a distal section with a cylindrical coupler. The adjustment rod is positioned within the cylindrical coupler for interlocking the distal section and the proximal section. A barrel support has a U-shaped barrel rest and a first support rod, the first support rod having a lower pass through coupled with a second support rod, the second support rod having a rotatable locking mechanism with back end with a third support rod projecting therefrom and adjacent the back end. An elbow support member has a first end coupled with the second distal end of the distal section of the first elongated support member. Included is a fourth support rod that has a first end that is coupled with the third support rod of the rotatable locking mechanism of the second support rod, and has a rotatable locking mechanism coupling with a second of the elbow support. A pair of arm supports is provided for securing the arm of a gun user to the first elongated support member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a right side view of the present invention in an operable orientation.

FIG. 4 is frontal view of the present invention in an operable orientation.

FIG. 7 is a frontal view of the wrist support.

FIG. 8 is a frontal view of the forearm support.

Similar reference characters refer to similar parts throughout the several views of the drawings.

DESCRIPTION OF THE PREFERRED EMBODIMENT

Figure 1:
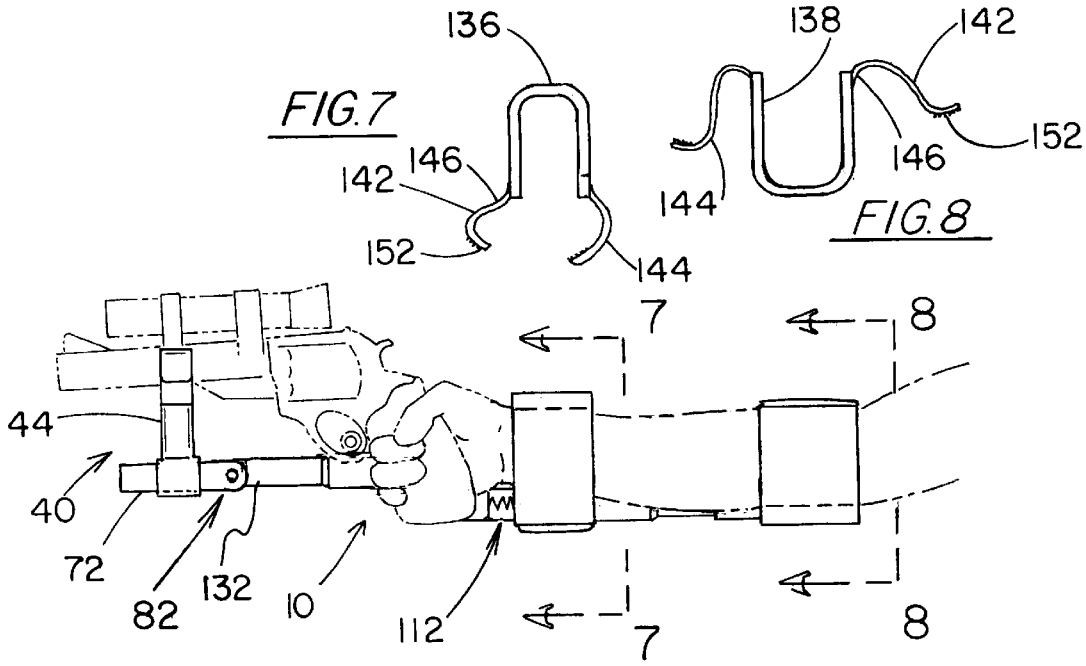
FIG. 1 is a perspective illustration of the preferred embodiment of the arm and hand gun support apparatus constructed in accordance with the principles of the present invention.

With reference now to the drawings, and in particular to FIG. 1 thereof, a new and improved arm and hand gun support apparatus embodying the principles and concepts of the present invention and generally designated by the reference numeral 10 will be described.

The present invention, the new and improved arm and hand gun support apparatus, is comprised of a plurality of components. Such components in their broadest context include a first elongated support member, a plurality of support rods, an elbow member and a barrel support. Such components are individually configured and correlated with respect to each other so as to attain the desired objective.

Figure 2:
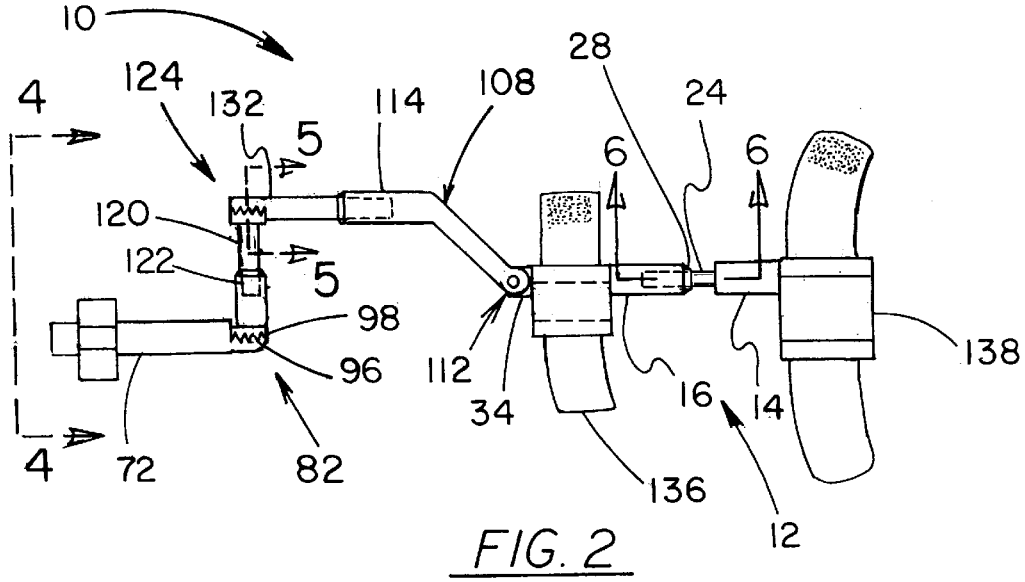
FIG. 2 is a top side view of the present invention in an operable orientation.

More specifically, the present invention includes a first elongated support member 12 as seen in FIG. 2. The first elongated support member has a proximal section 14 and a distal section 16. The proximal section and the distal section are formed of a plastic. The proximal section has a first proximal end 18 and a second proximal end 22. As seen in FIG. 2, the second proximal end has an adjustment rod 24 projecting outwardly therefrom. The distal section has a first distal end 28 with a cylindrical coupler 32 and a second distal end 34.

Figure 6:
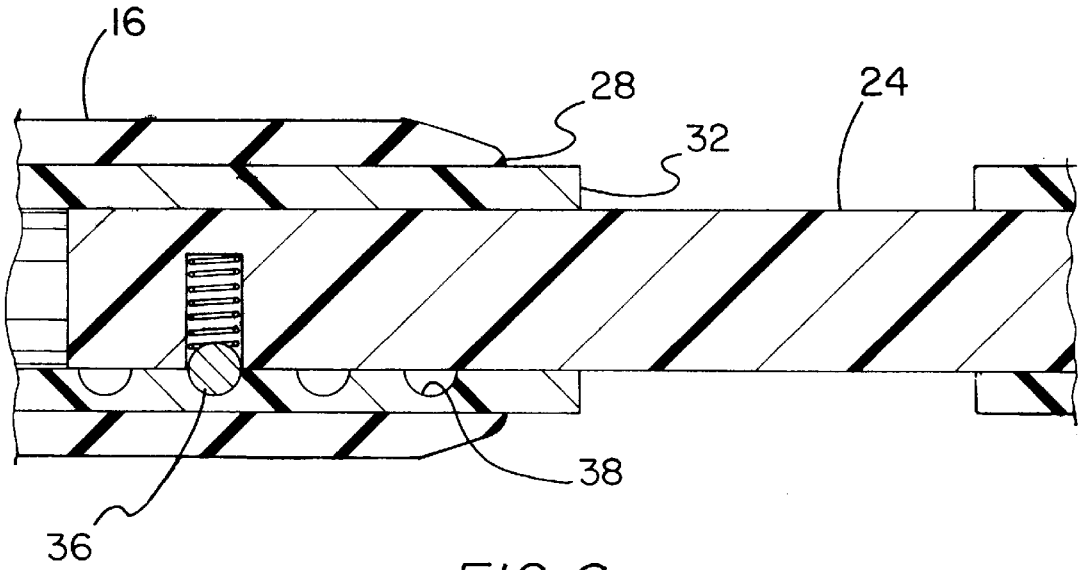
FIG. 6 is a cross sectional view of the coupling of the adjustment rod and the cylindrical coupler interlocked taken along line 6—6 of FIG. 2.

Also, the adjustment rod has a spring loaded release button 36, as seen in FIG. 6. The cylindrical coupler has a plurality of receiving slots 38 that are in linear alignment along the interior wall. The spring loaded release button engages any one of the slots when the adjustment rod is in place therein, as shown in FIG. 6. The adjustment rod can be moved in and out of the distal section to increase or decrease the length of the first elongated support member. The adjustment rod is positioned within the cylindrical coupler for interlocking the distal section and the proximal section. When the adjustment rod is positioned within the cylindrical coupler, the spring loaded release button engages one of the slots to hold the adjustment rod in position.

Included is an adjustable barrel support 40. As shown in FIG. 4, the adjustable barrel support has a U-shaped barrel rest 42 and a first support rod 44. The barrel rest is formed from a small bracket piece 46 and two large bracket pieces 48. The small bracket piece rests on top of the first support rod. The two large bracket pieces are mounted to symmetrical sides of the small bracket piece with a threaded adjustment screw 52. The small bracket has no threads in the opening. The adjustment screw has a rear portion 54, an upper portion 56 and a middle portion 58. The rear portion engages the threaded opening 60 of one of the two large brackets. The threaded upper portion engages the threaded opening 60 of another of the two large brackets. The two large brackets are capable of moving inwardly and outwardly with respect to the smaller bracket. The small bracket piece has a smooth channel interiorly to allow free movement of the adjustment screw within. This movement of the two larger brackets allows the barrel support to be adjusted according to the size of the gun barrel.

Additionally, the U-shaped barrel rest has a protective material 62 positioned over the small bracket and a pair of upper edges 64 of the two larger brackets. The protective material is a rubber or plastic that will not scratch the exterior of the gun barrel. The protective material is composed of two layers.

Figure 5:
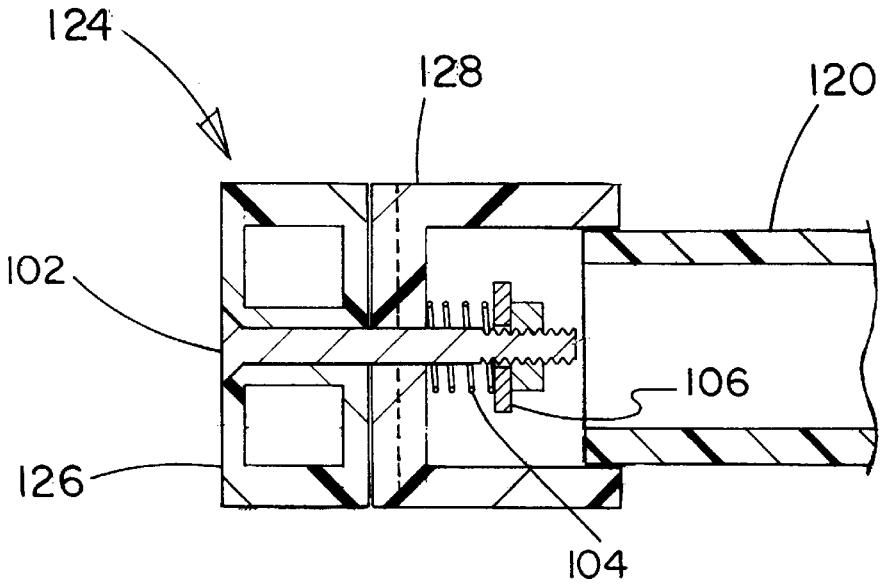
FIG. 5 is cross-sectional view of the locking mechanism taken along line 5—5 of FIG. 4.
Figure 9:
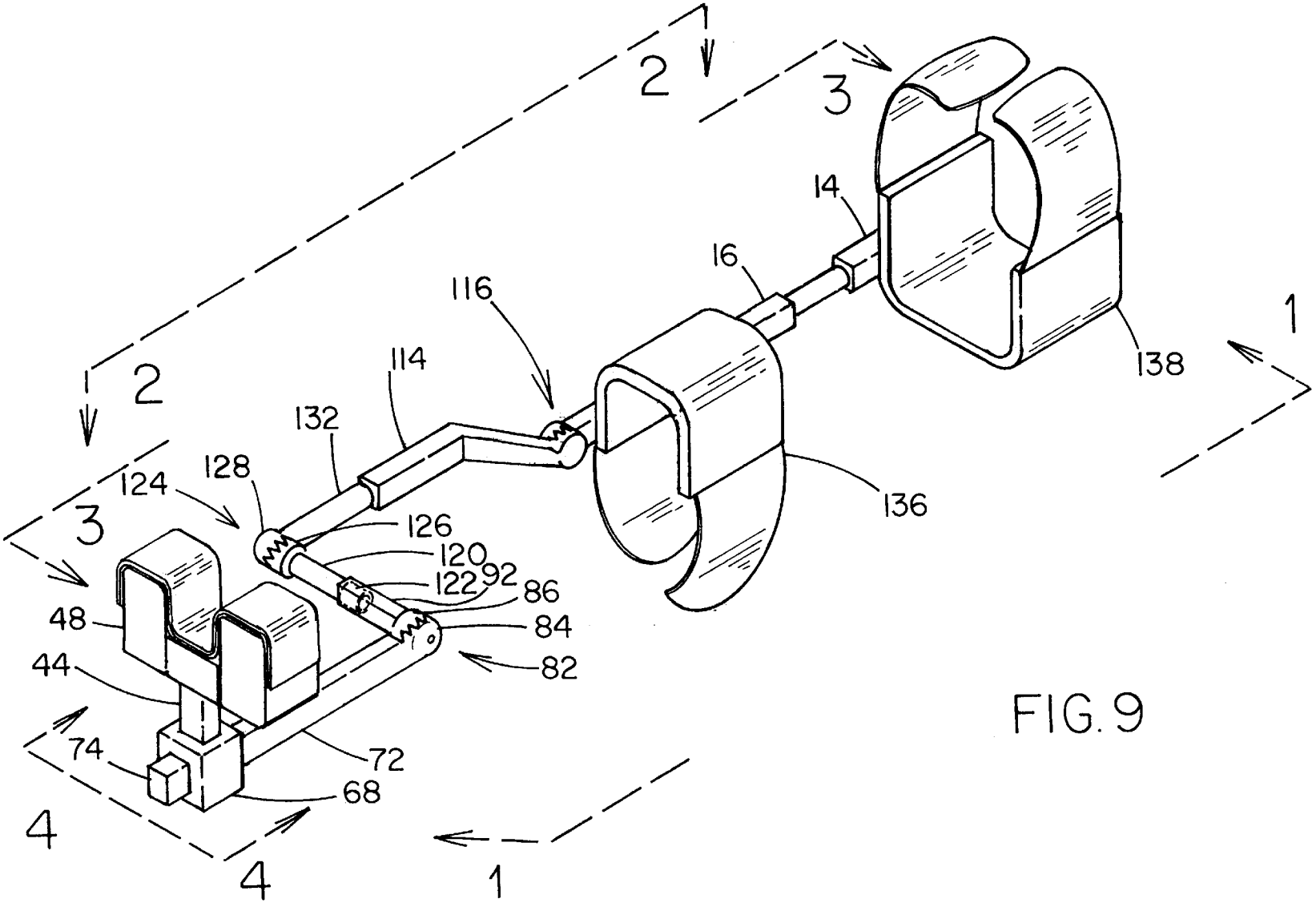
FIG. 9 is a frontal view of the rotatable locking mechanism of the second support rod taken along line 9—9 of FIG. 4.

The first support rod has a lower pass through 68 coupled with a second support rod 72, as shown in FIG. 9. The second support rod has a first end 74 that slidably engages the lower pass through of the first support rod. The second support rod has a rotatable locking mechanism 82 spaced from the first end. As depicted in FIG. 9, the rotatable locking mechanism has a first member 84 and a second member 86. The second member has a third support rod 92 projecting therefrom. The first member has a first serrated side 96 and the second member has a second serrated side 98. The first member and the second member are coupled by way of a coupling screw 102. Included within the first member is a spring 104 and stop washer 106. The coupling screw, as seen in FIG. 5, passes through the spring and the stop washer. The spring allows resilient coupling of the first and second members. The spring also allows the first serrated side of the first member to be releasably held in an interlocking orientation with the second serrated side of the second member.

As best illustrated in FIG. 2, an elbow support member 108 is provided. The elbow support member is formed of a pliable material for contorting. Preferably the material is a soft metal such as aluminum with a rubberized coating. The elbow support member has a first end 112 and a second end 114. The first end is coupled with the second distal end 34 of the distal section. The first end of the elbow support is a rotatable locking mechanism 116. The locking mechanism of the elbow support is identical to the rotatable locking mechanism 82 of the second support rod, and the second distal end 34 of the distal section 16 is identical to the first member 84 of the second support rod.

A fourth support rod 120 is provided. The fourth support rod has a first end 122 with a spring loaded release button. The spring loaded release button of the fourth support rod is identical to the spring loaded release button 36 of the adjustment rod and the spring loaded release button 76 of the second support rod. The first end is coupled with the third support rod 92 of the rotatable locking mechanism of the second support rod. The fourth support rod has a rotatable locking mechanism 124 at a second end. The rotatable locking mechanism 124 has a first member 126 and a second member 128 that are identical to the first member 84 and the second member 86 of the second support rod. The second member 128 of the locking mechanism has a fifth support rod 132 projecting therefrom and coupling with the second end 114 of the elbow support member 108, as seen in FIG. 2.

Lastly, a pair of arm supports formed by a wrist support 136 and a forearm support 138. The pair of arm supports of FIGS. 7 and 8 are each made of a rigid plastic. Each of the pair of arm supports has a pair of straps 142. Each strap has a first strap end 144 that is free and a second strap end 146 that is fixedly attached to the respective arm support. The first strap end of each of the pair of straps of the pair of arm supports each have a pile-type fastener 152 attached. Each of the pair of arm supports are slipped onto the arm and the elongated support member. The plurality of straps of each of the arm supports secures the arm of the hand gun user to the elongated support member. In use the wrist support goes over the wrist with the straps fastened over the proximal section, and the forearm support goes under the distal section with straps fastened over the forearm.

The present invention arm and hand gun support apparatus is specially designed for hand and arm support of the hand gun user. The apparatus will help to prevent movement of the arm and wrist while holding and firing the hand gun. The arm and hand gun support apparatus is mounted onto the arm of the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved arm and hand gun support apparatus for use when firing a hand gun comprising in combination:

a first elongated support member having a proximal section and a distal section, the proximal section having a first proximal end and a second proximal end with an adjustment rod projecting outwardly therefrom, the distal section having a first distal end with a cylindrical coupler and a second distal end, the adjustment rod being positioned within the cylindrical coupler for interlocking the distal section and the proximal section;

an adjustable barrel support having a U-shaped barrel rest and a first support rod, and a second support rod, the barrel rest being formed by a small bracket piece and two large bracket pieces coupled together and mounted on the first support rod, the U-shaped barrel rest having a protective material positioned over the small bracket piece and a pair of upper edges of the two large bracket pieces, the first support rod having a lower pass through coupled with the second support rod, the second support rod having a rotatable locking mechanism, the rotatable locking mechanism having a first member and a second member, the second member having a third support rod projecting therefrom, the first member having a first serrated side and the second member having a second serrated side, the first member and the second member being resiliently coupled for allowing the first serrated side of the first member to be held in an interlocking orientation with the second serrated side of the second member;

an elbow support member being formed of a pliable material for contorting thereof, the elbow support member having a first end and a second end, the first end being coupled with the second distal end of the distal section;

a fourth support rod having a first end and a rotatable locking mechanism at a second end, the first end being coupled with the third support rod of the rotatable locking mechanism of the fourth support rod having a fifth support rod coupling with the second end of the elbow support; and a pair of arm supports formed by a wrist support adapted for placement over the wrist of a user and a forearm support adapted for placement under the forearm of a user, each of the pair of arm supports being secured by a plurality of straps.

2. An arm and hand gun support apparatus comprising:

a first elongated support member having a proximal section and a distal section with a cylindrical coupler, the adjustment rod being positioned within the cylindrical coupler for interlocking the distal section and the proximal section;

a barrel support having a U-shaped barrel rest and a first support rod, and a second support rod and a third support rod, the first support rod having a lower pass through coupled with the second support rod, the second support rod having a rotatable locking mechanism with a back end with the third support rod projecting therefrom and adjacent the back end;

an elbow support member having a first end coupled with the second distal end of the distal section of the first elongated support member;

a fourth support rod having a first end being coupled with the third support rod of the rotatable locking mechanism of the second support rod, and having a rotatable locking mechanism coupling with a second end of the elbow support; and a pair of arm supports adapted for securing the arm of a gun user to the first elongated support member.

* * * * *